US006095238A

United States Patent [19]

Kawano et al.

[11] Patent Number: 6,095,238

[45] Date of Patent: Aug. 1, 2000

[54] FEED WATER HEATER

[75] Inventors: Shunji Kawano; Shoji Nakashima; Koichi Yoshimura, all of Yokohama; Kenji Sato, Hiratsuka; Hideki Sekiguchi, Yokohama, all of Japan

[73] Assignee: Kabushiki Kaisha Toshiba, Kawasaki, Japan

[21] Appl. No.: 09/199,488

[22] Filed: Nov. 25, 1998

[30] Foreign Application Priority Data

Nov. 26, 1997 [JP] Japan ..... 9-324773

[51] Int. Cl.[7] ..... F28B 3/00; F28B 9/10

[52] U.S. Cl. ..... 165/113; 165/114; 165/DIG. 207

[58] Field of Search ..... 165/114, 113, 165/917, DIG. 207, DIG. 208, DIG. 216

[56] References Cited

U.S. PATENT DOCUMENTS

| | | | |
|---|---|---|---|
| 1,543,677 | 6/1925 | Mallory | 165/917 |
| 1,745,857 | 2/1930 | Lucke | 165/113 |
| 2,756,028 | 7/1956 | Byerley | 165/113 |
| 2,995,341 | 8/1961 | Danesi | 165/113 |
| 3,407,873 | 10/1968 | Ryall | 165/DIG. 216 |
| 3,938,588 | 2/1976 | Coit et al. | 165/DIG. 208 |

FOREIGN PATENT DOCUMENTS

| | | |
|---|---|---|
| 59-14682 | 4/1984 | Japan . |
| 60-14964 | 4/1985 | Japan . |
| 63-684 | 1/1988 | Japan . |

*Primary Examiner*—Ira S. Lazarus
*Assistant Examiner*—Tho Duong
*Attorney, Agent, or Firm*—Oblon, Spivak, McClelland, Maier & Neustadt, P.C.

[57] ABSTRACT

A feed water heater has a longitudinally cylindrical body comprising a cylindrical shell portion constituting a main body portion of a feed water heater and a water box-shaped chamber operatively connected to the cylindrical shell portion and partitioned by a tubesheet. In the cylindrical shell portion, a heat exchanger tube bank is arranged and supported by a plurality of support plates, a drain cooling section is disposed in association with the heat exchanger tube bank for carrying out a heat recovery of a drain generated in the heat exchanger tube bank, a dilution condensing chamber is provided for the heat exchanger tube bank and adapted to excessively flow the steam into the heat exchanger tube bank, and a non-condensable gas chamber is provided for the heat exchanger tube bank. The drain cooling section, the dilution condensing chamber and the non-condensable gas chamber are arranged axially in this order in the cylindrical shell from the tube sheet.

21 Claims, 10 Drawing Sheets

FEED WATER HEATER

BACKGROUND OF THE INVENTION

The present invention relates to a feed water heater which is applied to thermal and nuclear power generation plants, and in particular, to a feed water heater which reduce low a solubility of an oxygen gas contained in a non-condensable gas generated during a heat exchanging process between a heating source and a source to be heated (heated source) to a steam condensing zone (drain collection zone).

In general, a feed water heater, which is applied to a thermal and nuclear power generation plant, has a structure, specifically, in which a turbine exhaust gas, which has performed expansion work in a steam turbine, is condensed into a condensed water (condensate) by means of a condenser, and then, when the condensed water is returned to a steam generator as a feed water, the condensed water makes a heat exchange with a turbine extraction steam so as to recover heat. For example, there is provided a conventional feed water heater having a structure shown in FIG. 9 to FIG. 11, in which FIG. 9 shows a horizontal sectional view of the feed water heater, FIG. 10 shows a cross sectional view taken along an arrow X—X in FIG. 9, and FIG. 11 shows a partially enlarged view of a portion XI in FIG. 9.

The feed water heater is composed of a semi-spherical water box 2 which is partitioned by a tubesheet (header) 1, and a transversely long cylindrical shell 3.

The water box 2 is partitioned by a partition (compartment) plate 4 and includes a feed water inlet 5 for guiding a condensed water supplied from a condenser (not shown) as a feed water, and a feed water outlet 6 for returning a feed water, which is heat-exchanged and preheated in the cylindrical shell 3, to a steam generator (not shown).

On the other hand, in the cylindrical shell 3, which contains U-shaped heat exchanger (transfer) tubes 8, as a plurality of tube banks, which is supported by the tubesheet 1 and a support plate 7, and a non-condensable gas vent tube 10 is provided for the central portion between the tube banks so as to extend axially and having suction ports.

Further, the cylindrical shell 3 is provided with a steam inlet 11 for introducing a turbine extraction steam as a heating source at its one side and an impingement plate 12 for reducing an impact stress of the turbine exhaust steam to the heat exchanger tube 8 at a position slightly separated from the steam inlet 11.

Further, the cylindrical shell 3 is formed with a steam condensing section 13 at the outer side of the heat exchanger tubes 8, and a drain cooling section 16 which is located beside the tubesheet 1 and is defined by a partition (compartment) plate 14. In the steam condensing section 13, the turbine extraction steam, which is introduced from the steam inlet 11 as a heating source, makes a heat exchange with a feed water flowing through the heat exchanger tubes 8, and then, a drain (condensed water) whose temperature becomes slightly low is gathered (on the bottom of the shell 3). On the other hand, in the drain cooling section 16, a heat is further recovered from the drain guided from the bottom of the shell 3 via a drain inlet 15.

In the drain cooling section 16, baffle plates 4 are alternately arranged so that the drain containing a bubble 17, which is entrained from the bottom of the shell 3 via the drain inlet 15, flows meanderingly. For this time, a retained heat of the drain is given to the feed water flowing through the heat exchanger tubes 8, and then, is supplied as a heating source for the feed water from a drain outlet 18 to, for example, another feed water heater.

As described above, the conventional feed water heater is provided with the steam condensing zone 13 and the drain cooling section 16 and is constructed in a manner that the heat of turbine extraction steam, used as a heating source, is almost thoroughly given to the feed water, and the heat is effectively used so as to improve a heat exchanging efficiency.

Recently, in the feed water heater, in the case of making a heat exchange of a turbine extraction steam used as a heating source with a feed water used as a heated source, concentration of an oxygen gas contained in a non-condensable gas concentrated in a steam has provided a problem.

That is, the oxygen gas contained in the non-condensable gas is partly dissolved in a condensing drain, and it is well known that the concentration of oxygen gas dissolved in the drain depend upon partial pressure of an oxygen gas according to Henry's law in the case where a temperature is constant. If the oxygen gas together with other non-condensable gas is left alone, the heat exchanging efficiency becomes worse, and the oxygen gas is dissolved in the drain with high concentration. This is a factor of corroding component members of the feed water heater. For this reason, in the conventional feed water heater, as shown in FIG. 9 and FIG. 10, the oxygen gas contained in the non-condensable gas concentrated during the heat exchanging process is gathered to the suction ports 9 of the non-condensable gas vent tube 10 located at the center of the heat exchanger tubes 8, and then, is discharged, with a certain amount of steam, to the outside from the feed water heater. This discharge rate is set within a range from about 0.5 to 2.5% of the turbine extraction steam supplied to the feed water heater, although it is different depending upon a type of plant.

However, according to recent research, the following matter has been found. That is, even if the non-condensable gas is gathered to the non-condensable gas vent tube 10 and is discharged to the outside of the feed water heater, during the heat exchanging process, the turbine extraction steam is condensed into a drain, and then, an oxygen gas of high concentration is still dissolved in the drain. The solution mechanism of oxygen gas to the drain will be described in more detail hereunder.

A solubility of the oxygen gas to the drain depends upon Henry's law in principle. However, if a bubble is mixed into the drain, the dissolved oxygen gas concentration rapidly becomes high. That is, if a bubble is mixed into the drain, the pressure of bubble rises up by a hydraulic pressure, and then, steam in the bubble is condensed into a drain rapidly due to cooling by the drain around the bubble. A partial pressure of the oxygen gas together with other non-condensable gas in the bubble rises up, and the solubility to the drain increases. As a result, the bubble becomes small, and the curvature of the surface of the bubble becomes large. For this reason, the pressure of bubble rises up more and more by the influence of surface tension, and the steam in the bubble is further condensed while the non-condensable gas being much dissolved in the drain. Finally, the bubble disappears or diminishes, and as a result, the drain contains an oxygen gas of high concentration.

The inventor of the present invention has carefully observed a change of drain taking the research result as described above into consideration. As a result, in the conventional feed water heater, as shown in FIG. 11, during the heat exchange with the feed water flowing through the heat exchanger tubes 8, a drain generated in the steam condensing section 13 flows into the drain cooling section 16 together with a bubble 17 via the drain inlet 15 and a clearance between the tube and the tube hole of the partition plate 14 supporting the heat exchanger tubes 8. Therefore, there is the possibility that a drain system after the drain cooling section 16 comes into contact with a dissolved oxygen gas of high concentration, and thereby, component members are corroded. For this reason, it has been desired to realize a feed water heater which can make low a dissolved oxygen gas concentration when the drain generated in the steam condensing section 13 flows into the drain cooling section 16 together with a bubble 17.

SUMMARY OF THE INVENTION

An object of the present invention is to substantially eliminate defects or drawbacks encountered in the prior art mentioned above and to provide a feed water heater which is provided with a dilution condensing chamber for previously diluting a non-condensable gas in the vicinity of a drain cooling section, supplies a drain after being made into a drain of low oxygen gas concentration to the drain cooling section, and is kept in a stable state without causing a corrosion in the drain cooling section.

This and other objects can be achieved according to the present invention by providing a feed water heater comprising:

- a cylindrical shell portion constituting a main body portion of a feed water heater;
- a water box operatively connected to the cylindrical shell portion and partitioned by a tubesheet;
- a heat exchanger tube bank arranged in the cylindrical shell portion and supported by support means therein;
- a drain cooling section disposed in association with the heat exchanger tube bank for carrying out a heat recovery of a drain generated in the heat exchanger tube bank;
- a steam supply means provided for the cylindrical shell portion for supplying a steam as heating medium;
- a dilution condensing chamber provided for the heat exchanger tube bank and adapted to excessively flow the steam into the heat exchanger tube bank; and
- a non-condensable gas chamber provided for the heat exchanger tube bank for almost completely condensing the steam.

In preferred embodiments, the dilution condensing chamber is located adjacent to a drain inlet of the drain cooling section and the non-condensable gas chamber is located adjacent to the dilution condensing chamber so that the dilution condensing chamber is interposed between the non-condensable gas chamber and the drain cooling section.

The support means is composed of a plurality of support plates supporting the heat exchanger tube bank, the dilution condensing chamber has a box-shaped structure utilizing the support plates and extending along a direction perpendicular to a location of the steam supply means formed as a steam inlet to an outer wall section of the cylindrical shell portion. The dilution condensing chamber is provided with a flow guide disposed on a side of the steam supply means so as to surround an outer side of the heat exchanger tube bank. The flow guide is formed with a steam port and has a semicircular structure so as to surround the outer side of the heat exchanger tube bank with a space therebetween. The end portions of the flow guide may be bent inward.

The box-shaped dilution condensing chamber has a bottom portion which is closed by a blocking plate to which a drain outlet is formed in a lattice arrangement, for example, formed by a perforated plate, a netted flat plate or a lattice plate.

The drain outlet formed to the blocking plate is composed of louver means, the louver means comprising flat plates having an opening with an inclination to the heat exchanger tube bank.

The box-shaped dilution condensing chamber has a bottom portion which is closed by a blocking plate and is provided with louver means composed of flat plates which face the blocking plate with an inclination to the blocking plate.

The dilution condensing chamber is provided with a drain chamber which is formed by a section plate defining the drain cooling section and a partition plate. The dilution condensing chamber is separated from the non-condensable gas chamber by one of the support plates to which a steam inlet is formed. The steam inlet has an egg crate shape formed by assembling thin plates in an inclining lattice arrangement.

The non-condensable gas chamber has a box-shaped structure utilizing the support plates, is operatively connected to the dilution condensing chamber and is formed with a non-condensable gas collection port surrounded by baffle plates which are arranged to cause a meandering steam flow.

The non-condensable gas chamber is formed with a steam inlet port which is formed to each of the support plate partitioning the dilution condensing chamber and another support plate opposite thereto.

Another steam supply means including a plurality of steam inlet ports is also formed to an outer wall section of the cylindrical shell portion so that a balance of inflow steam rate is taken with respect to the former mentioned steam supply means. A a non-condensable gas vent tube is further disposed at substantially a central portion of the heat exchanger tube bank so as to extend along an axial direction of the cylindrical shell portion and operatively connected to the non-condensable gas chamber. The non-condensing gas vent tube is formed with a plurality of suction ports along an axial direction thereof for sucking the steam.

The nature and further characteristic features of the present invention will be made more clear from the following descriptions made with reference to the accompanying drawings.

DESCRIPTION OF THE PREFERRED EMBODIMENT

A preferred embodiments of a feed water heater according to the present invention will be described hereunder with reference to the accompanying drawings.

Figure 1:
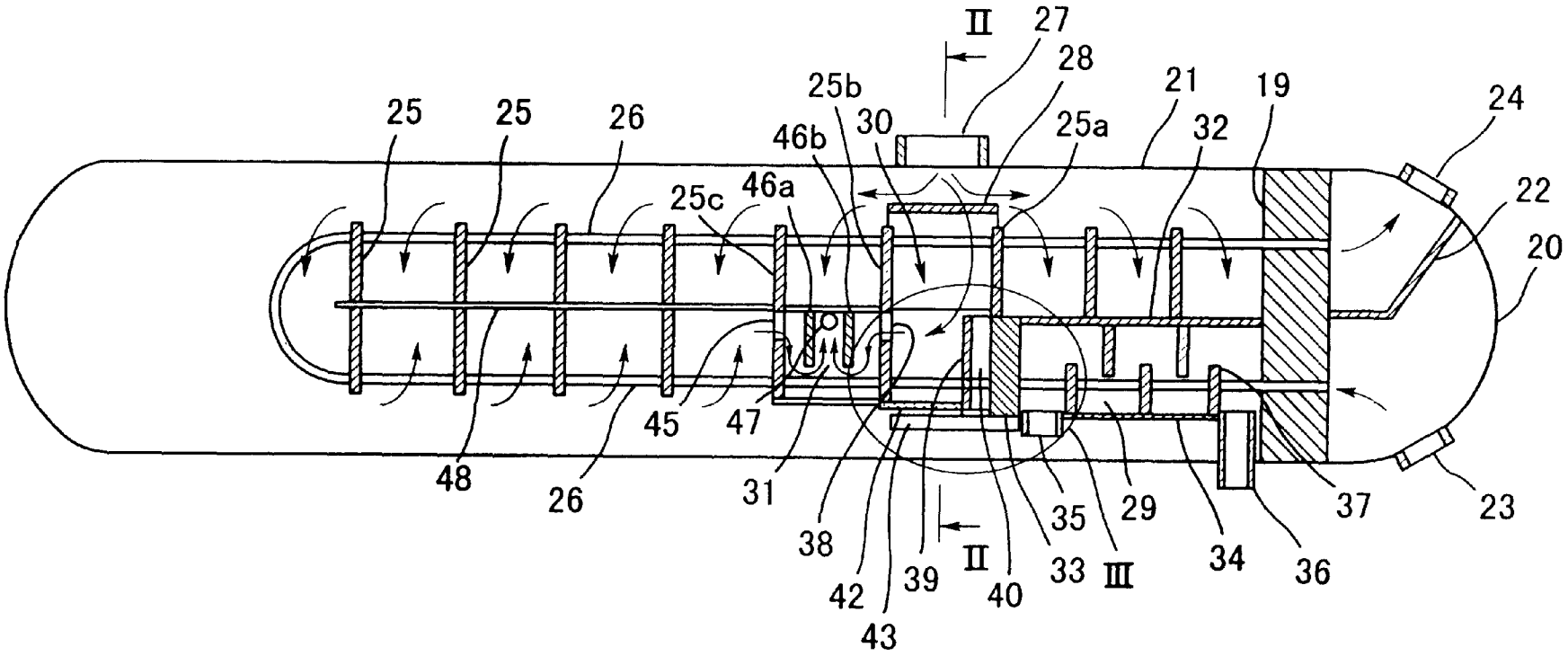
FIG. 1 is a longitudinal sectional view schematically showing a feed water heater according to one embodiment of the present invention.
Figure 2:
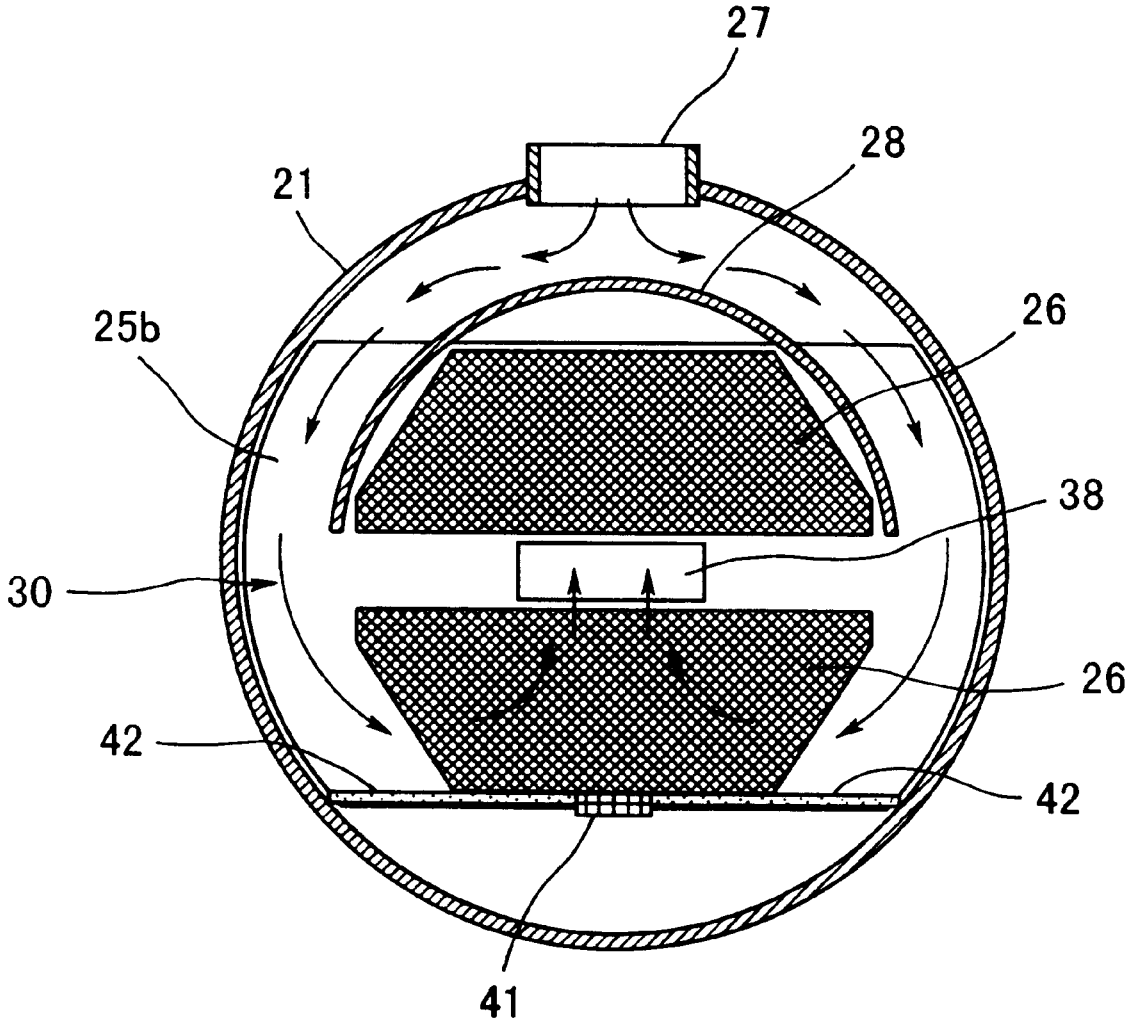
FIG. 2 is a cross sectional view taken along an arrow II—II in FIG. 1.
Figure 3:
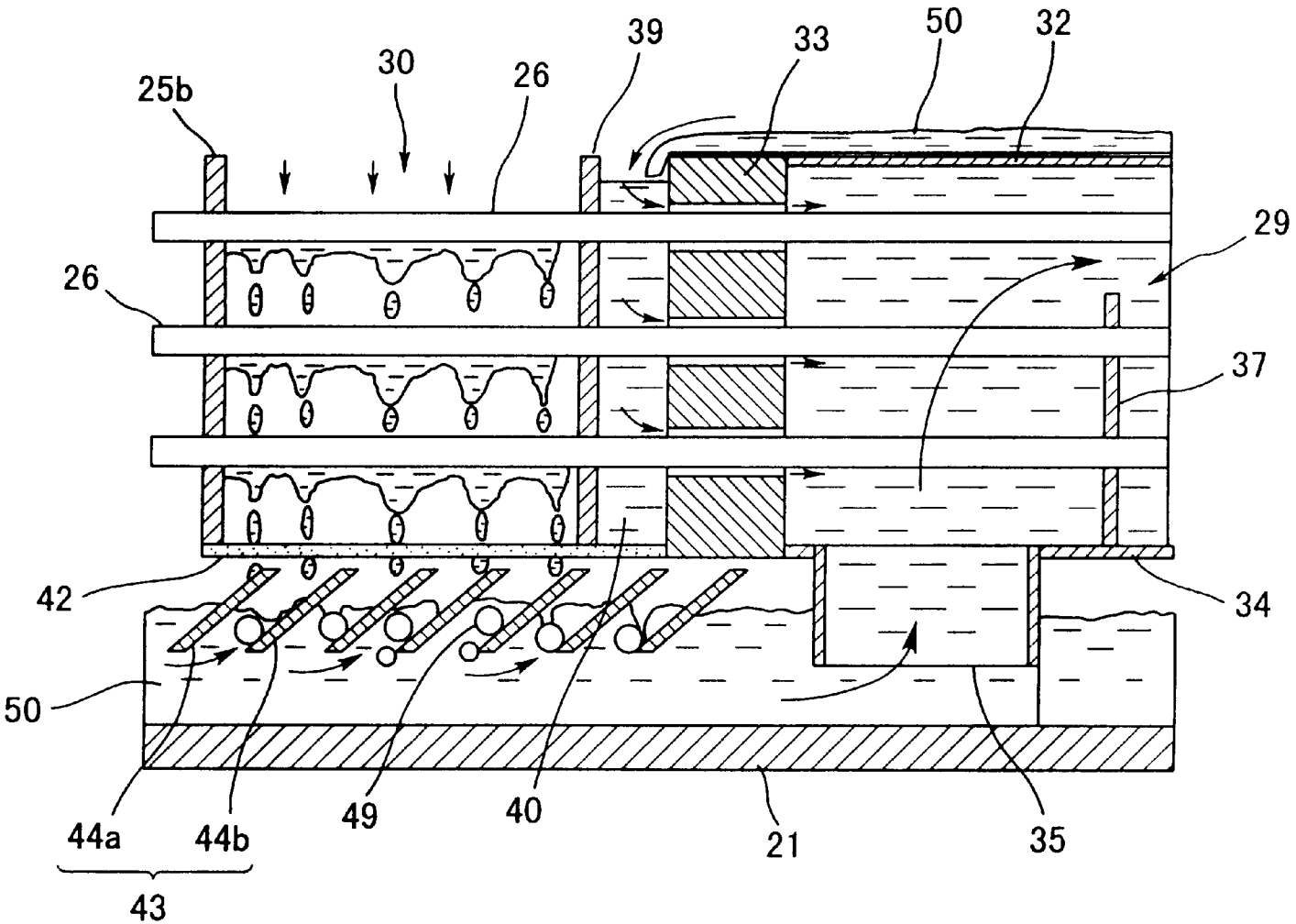
FIG. 3 is a partially enlarged view showing a portion III in FIG. 1.

FIGS. 1 to 3 are cross sectional views showing a feed water heater according to one embodiment of the present invention.

With reference to FIGS. 1 to 3, the feed water heater is composed of a body portion having a semi-spherical water box 20 and a cylindrical shell 21 which is partitioned by a tubesheet 19 as a header.

The water chamber 20 is partitioned by a partition plate 22 and includes a feed water inlet 23 for introducing a condensed water supplied from a condenser (not shown) as a feed water and a feed water outlet 24 for returning a feed water, which is heat-exchanged and pre-heated in the main cylindrical shell 21, to a steam generator (not shown).

On the other hand, the cylindrical shell 21 receives U-shaped heat exchanger (transfer) tubes 26 as tube bank which is supported by the tubesheet 19 and support plates 25, 25*a*, 25*b*, . . .

Further, the cylindrical shell 21 is provided at its outer wall section with a steam inlet 27 for guiding a turbine extraction steam as a heating source and a semi-circular flow guide 28 which is formed so as to surround an outer side of the heat exchanger tubes 26 as the tube bank at a position slightly separated from the steam inlet 27.

The cylindrical shell 21 is provided with a drain cooling section 29, a dilution condensing chamber 30 and a non-condensable gas chamber 31, which are arranged successively in an axial direction in the cylindrical shell from the tubesheet 19. The drain cooling section 29 is defined by the tubesheet 19, a ceiling plate 32, a partition plate 33 and a bottom plate 34 like a closed room. The bottom plate 34 is provided with a drain inlet 35 and a drain outlet 36. Moreover, the heat exchanger tubes 26 is supported inside the drain cooling section 29, and the drain cooling section 29 is further provided with baffle plates 37 which are alternately arranged so as to form a drain flow path in a meandering manner.

The dilution condensing chamber 30 is formed like a box which extends along the perpendicular direction to a steam inlet 27 from the lower side, as viewed, of the flow guide 28 formed so as to surround the outer side of the heat exchanger tubes as a tube bank and is defined between a support plate 25*a* supporting the heat exchanger tubes 26 and the adjacent support plate 25*b* including a steam inlet 38. Thus, the dilution condensing chamber 30 is constructed so that a flow velocity is made relatively fast, and a relatively much steam (turbine extraction steam) flows from both ends of the flow guide 28. Further, the box-like dilution condensing chamber 30 includes a drain chamber 40 which is formed by the partition plate 33 defining the drain cooling section 29 and a partition plate 39 having an opening at its upper (head) portion. As shown in FIG. 2, a bottom portion of the dilution condensing chamber 30 is provided with a lattice drain outlet 41 and a blocking plate 42 which extends along the axial direction of the cylindrical shell 21. Furthermore, the box-like dilution condensing chamber 30 includes a louver section 43 facing the blocking plate 42. As shown in FIG. 3, the louver section 43 is composed of flat plates 44*a* and 44*b* which are arranged with an inclination to the dilution condensing chamber 30.

On the other hand, as shown in FIG. 1, the non-condensable gas chamber 31 is connected to the dilution condensing chamber 30 and is formed like a box defined by a support plate 25*b* of the dilution condensing chamber 30 and an adjacent support plate 25*c* having a steam inlet 45. Further, the non-condensable gas chamber 31 is provided with a non-condensable gas collection port 47 which is surrounded by baffle plates 46*a* and 46*b*. A reference numeral 48 denotes a split flow plate which is located so that a steam supplied from the steam inlet 27 via the flow guide 28 flows in a manner of being distributed into both of a head side heat exchanger tubes 26 and a bottom side heat exchanger tubes 26, as shown by plural arrows of FIG. 1, as viewed in the illustrated arrangement.

The feed water heater of this embodiment will be operated as follows.

When a feed water is supplied from the feed water inlet 23 via the water box 20 and the heat exchanger tubes 26 while being inverted and flows into the feed water outlet 24, a steam (turbine extraction steam) flows into the cylindrical shell 21 from the steam inlet 27. As shown in FIG. 1, the steam is dispersed to the heat exchanger tubes 26 as shown by the arrows via the flow guide 28. As shown in FIG. 2, a steam flowing along the flow guide 28 is supplied to the bottom side heat exchanger tubes 26 of the dilution condensing chamber 30 because a passage width is narrow, and therefore, much steam flows relatively fast.

While the steam makes a heat exchange with a feed water flowing through the heat exchanger tubes 26, a non-condensable steam flows into the non-condensable gas chamber 31 together with a non-condensable gas via the steam inlet 38 of the support plate 25*b*, as shown in FIG. 1. In the non-condensable gas chamber 31, the steam with non-condensable gas meanderingly flows by the baffle plates 46*a* and 46*b* and condenses further by making a heat exchange with the feed water of the heat exchanger tubes 26. Then, the non-condensable gas containing an oxygen gas further concentrated through the heat exchanging process is collected to the non-condensable gas collection port 47, and then, is discharged to the outside of the feed water heater. Further, remaining steam with a non-condensable gas flows into the non-condensable gas chamber 31 from the steam inlet of the support plate 25*c*. In this case, an opening area of each steam inlet 38 and 45 is set so that the balance of non-condensable steam rate is kept.

On the other hand, the drain condensed in the dilution condensing chamber 30 is collected to the louver section 43 as shown in FIG. 3 via the lattice drain outlet 41 located on the blocking plate 42 as shown in FIG. 2. At this time, when a bubble 49 is generated, the bubble 49 is collected on a free surface of a drain 50 along the flat plates 44*a* and 44*b* arranged in an inclined state, and then, is separated from the drain 50. When the bubble 49 is separated from the drain 50, the bubble is no more entrained into the drain cooling section 29. The an oxygen gas solubility of the drain 50 was much lowered than the oxygen gas solubility in the conventional technology.

The drain 50, which is separated from the bubble 49, flows into the drain cooling section 29 via the drain inlet 35, and then, makes a heat exchange with the feed water of the heat exchanger tubes 26 while meanderingly flowing by the baffle plate 37, and thus, the heat recovery of drain is carried out.

Further, the drain 50, which makes a heat exchange with the feed water of the heat exchanger tubes 26 at the outside upper of the drain cooling section 29, is collected from the ceiling plate 32 to the drain chamber 40 provided in the dilution condensing chamber 30, as shown in FIG. 3. Then, the drain 50 flows into the drain cooling section 29 from the drain chamber 40 via a clearance of the support plate 33 supporting the heat exchanger tubes 26.

Therefore, the steam having concentrated oxygen gas does not directly penetrate into the drain chamber 40 from the clearance between the partition plate 33 and the heat exchanger tube 26.

As described above, in this embodiment, the cylindrical shell 21 is formed with the box-like dilution condensing chamber 30 and non-condensable gas chamber 31 with the use of the support plates 25*a*, 25*b* and 25*c* supporting the heat exchanger tube 26. The dilution condensing chamber 30 is formed with the drain chamber 40 and is provided with the louver section 43 at the bottom side of the dilution condensing chamber 30. Thus, much steam relatively fast flows into the dilution condensing chamber 30 and is condensed into a drain so as not to increase the non-condensable gas concentration of the remaining steam. Therefore, it is possible to make low a dissolved oxygen gas concentration of the bubble 49 caused when a condensing drain generated in the dilution condensing chamber 30 drops down on the water surface, and the bubble 49 is securely separated (vanished) by the louver section 43, and thereafter, the drain flows into the drain cooling section 29. Therefore, the drain cooling section 29 can be kept in a stable state that the oxygen gas concentration is low and almost no corrosion is caused.

The embodiment of the feed water heater mentioned above will involve the following modified examples.

Figure 4:
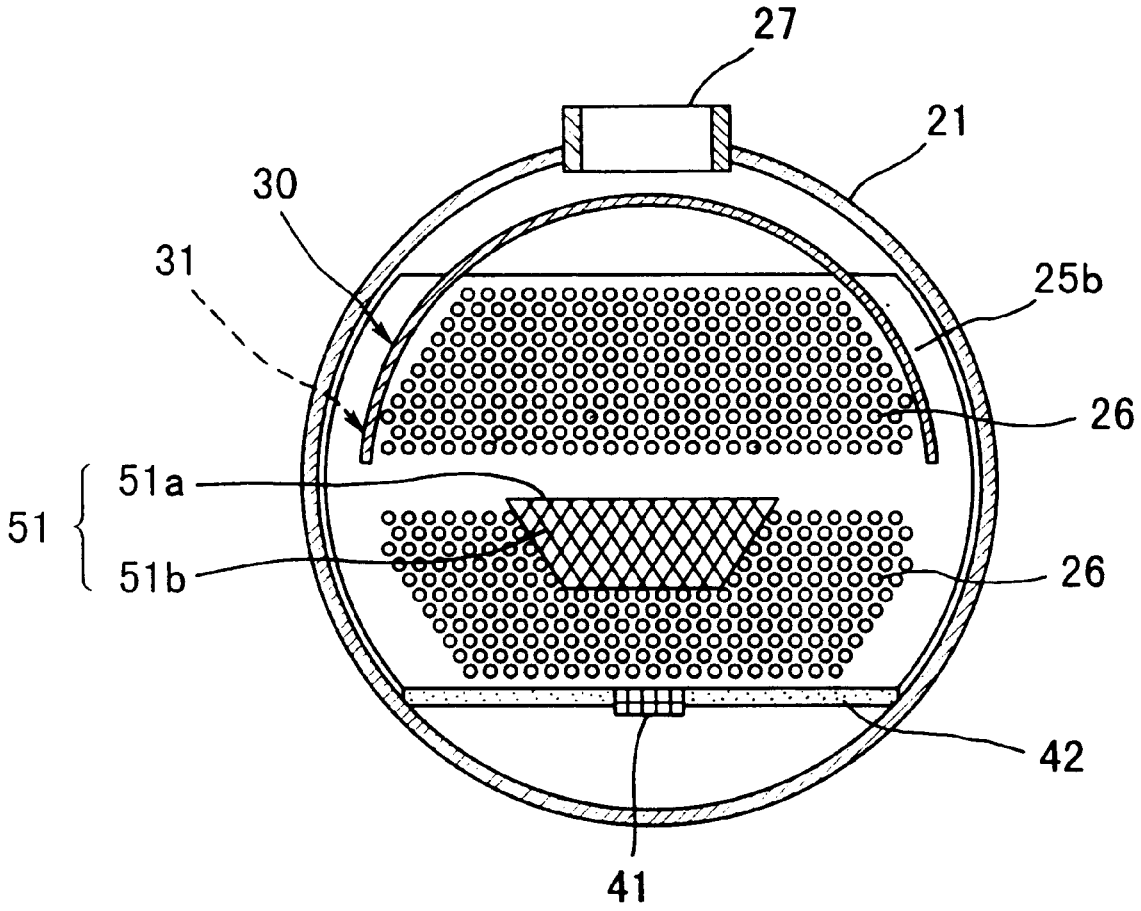
FIG. 4 is a sectional view schematically showing a first modified example of the feed water heater according to the embodiment of the present invention.

FIG. 4 is a sectional view schematically showing a first modified example of the feed water heater according to the embodiment of the present invention mentioned above.

In this example, the support plate 25*b* partitioning the dilution condensing chamber 30 and the non-condensable gas chamber 31 is provided with an egg-crate like (egg-shaped net basket) steam inlet 51 which is constructed in a manner that thin plates 51*a* and 51*b* are mutually combined like an inclined lattice in section.

As described above, in this example, the support plate 25*b* is provided with the egg-crate like steam inlet 51, so that an inlet portion for supplying the non-condensable steam from the dilution condensing chamber 30 to the non-condensable gas chamber 31 can be freely arranged, which therefore serves to improve a flow efficiency of drain.

Figure 5:
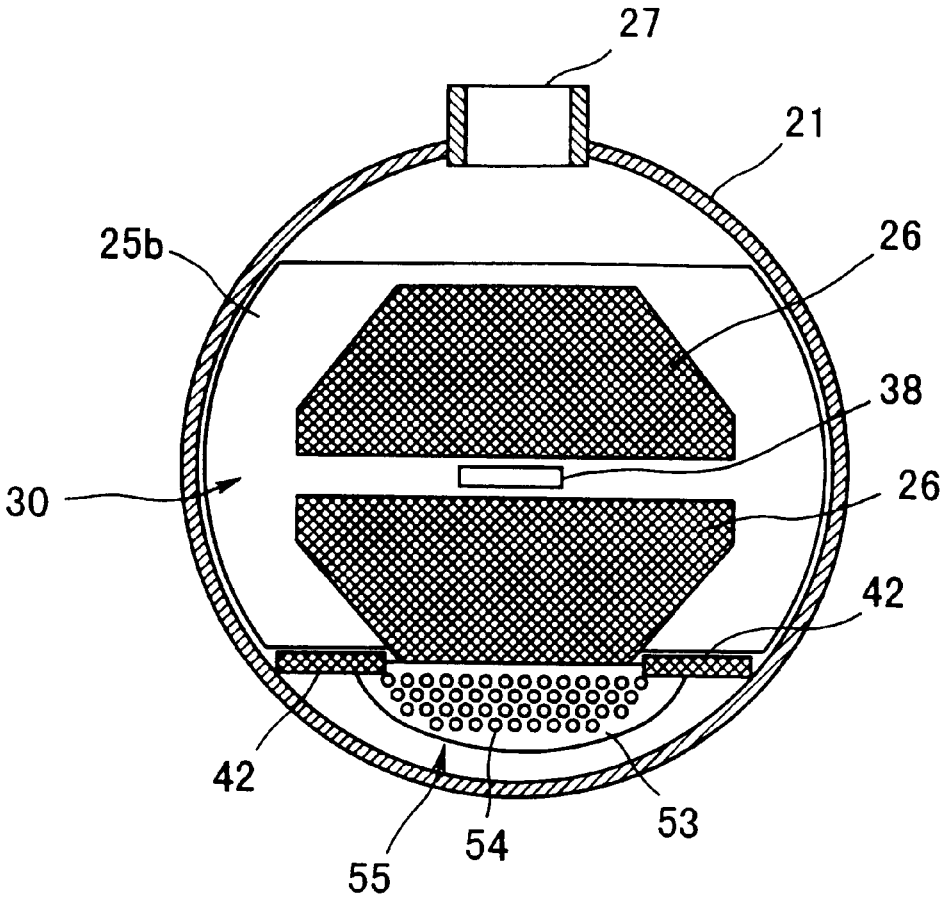
FIG. 5 is a sectional view schematically showing a second modified example of the feed water heater according to the embodiment of the present invention.

FIG. 5 is a sectional view schematically showing a second modified example of the feed water heater according to the embodiment of the present invention.

Figure 6:
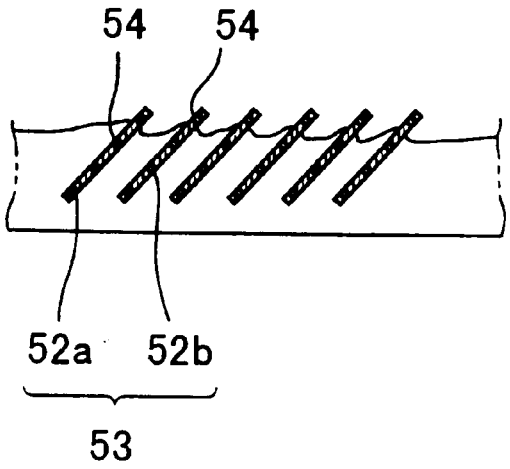
FIG. 6 is a side view showing a louver section located on the side of a drain outlet of a blocking plate shown in FIG. 5.

In this example, a drain outlet 55 of the blocking plate 42 defining the box-shaped dilution condensing chamber 30 is provided with a louver section 53. The louver section 53 is constructed, as shown in FIG. 6, in a manner that flat plates 52*a* and 52*b* having an opening portion 54 are arranged in a state of being inclined to the heat exchanger tubes 26. The blocking plate 42 may be formed of a perforated plate, a netted flat plate or a lattice-shaped plate.

As described above, in this example, the drain outlet 55 of the blocking plate 42 is provided with the louver section 53, so that even if the drain contains a bubble, the bubble can be securely vanished together with the lattice-shaped blocking plate 42. Therefore, the drain can be supplied into the drain cooling section 29 in a stable state of containing no bubble.

Figure 7:
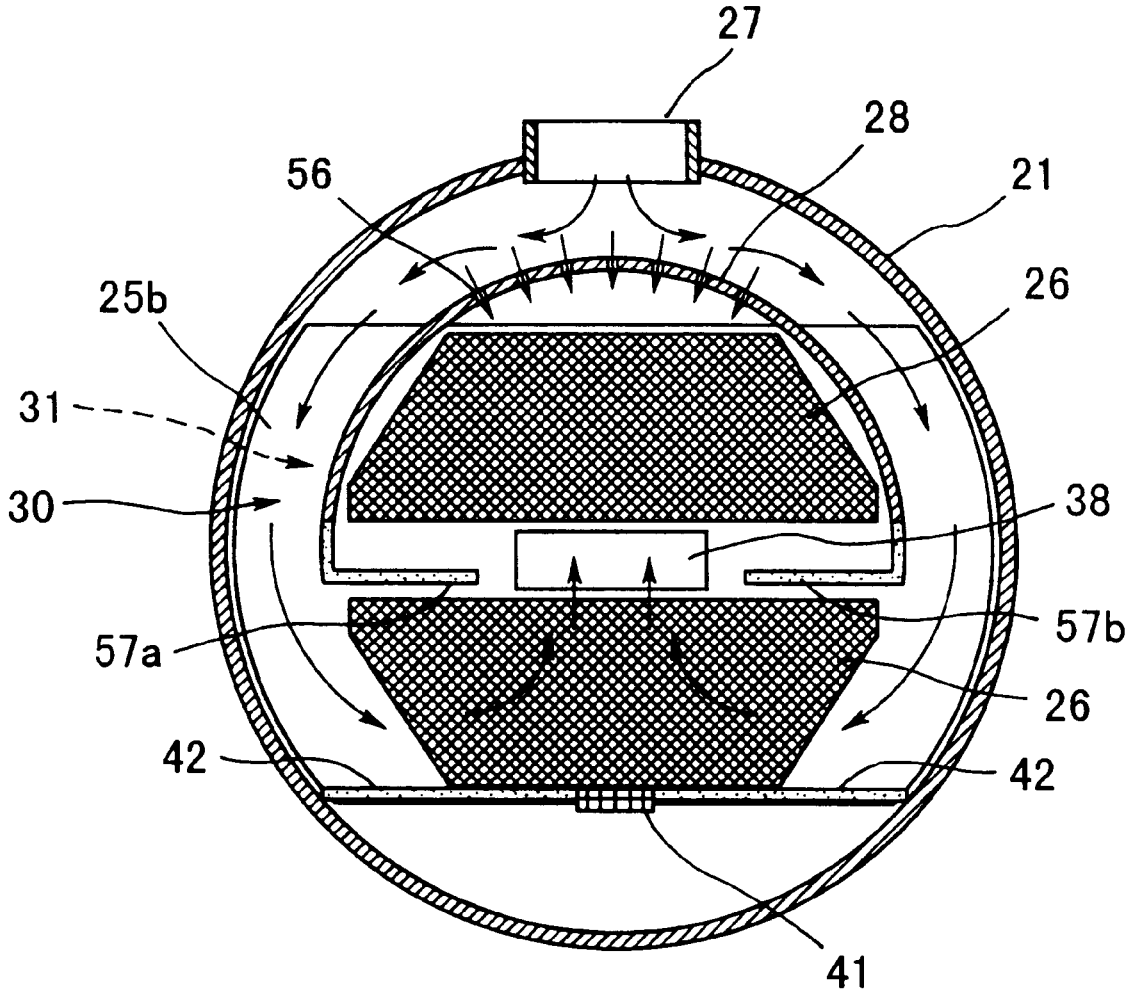
FIG. 7 is a sectional view schematically showing a third modified example of the feed water heater according to the embodiment of the present invention.

FIG. 7 is a sectional view schematically showing a third modified example of the feed water heater according to the embodiment of the present invention.

In this example, the flow guide 28, which is formed so as to surround the outside of the heat exchanger tubes 26 as a tube bank, is formed with a relatively small-diameter steam port 56, and is provided with bent (L-shaped) end portions 57*a* and 57*b* which are bent towards (inward) the steam inlet 38.

As described above, in this example, the flow guide 28 is formed with the steam port 56 and is provided with bent portions 57*a* and 57*b* at its both end portions. Therefore, a steam flowing into the steam inlet 38 of the non-condensable gas chamber 31 can be directly restricted without contacting the heat exchanger tubes 26, and the steam can be much made into a drain in the dilution condensing chamber 30.

Figure 8:
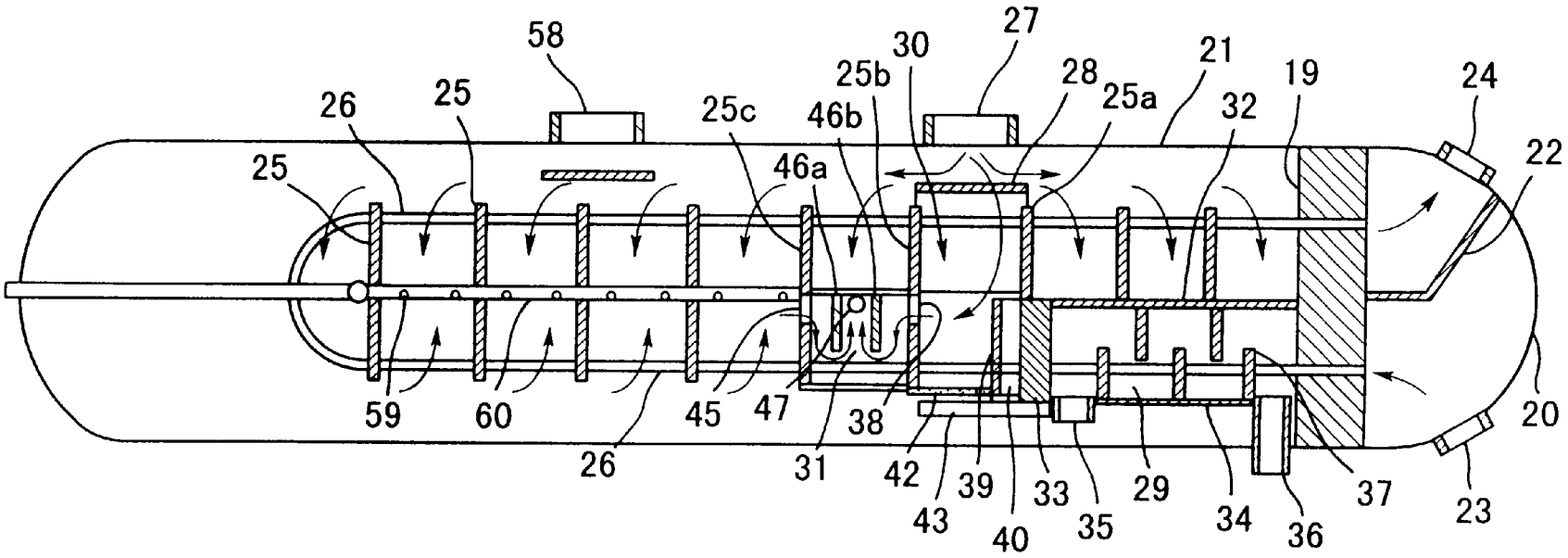
FIG. 8 is a longitudinal sectional view schematically showing a fourth modified example of the embodiment of the feed water heater according to the present invention.
Figure 9:
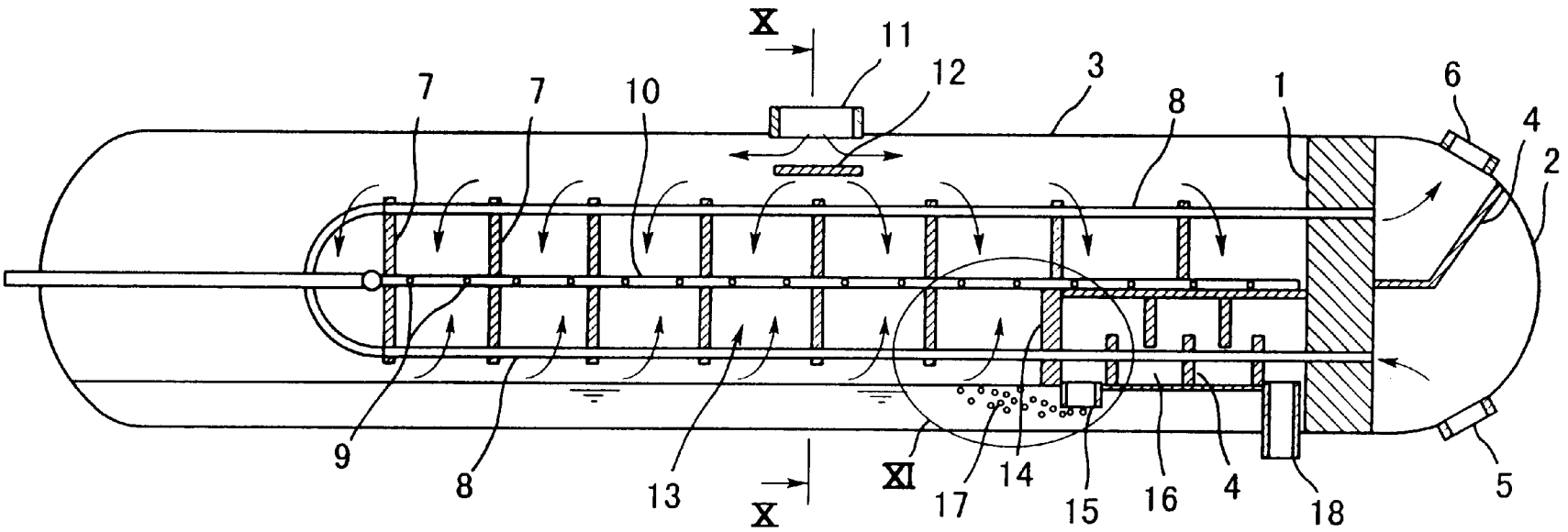
FIG. 9 PRIOR ART
FIG. 9 is a longitudinal sectional view schematically showing a conventional feed water heater.
Figure 10:
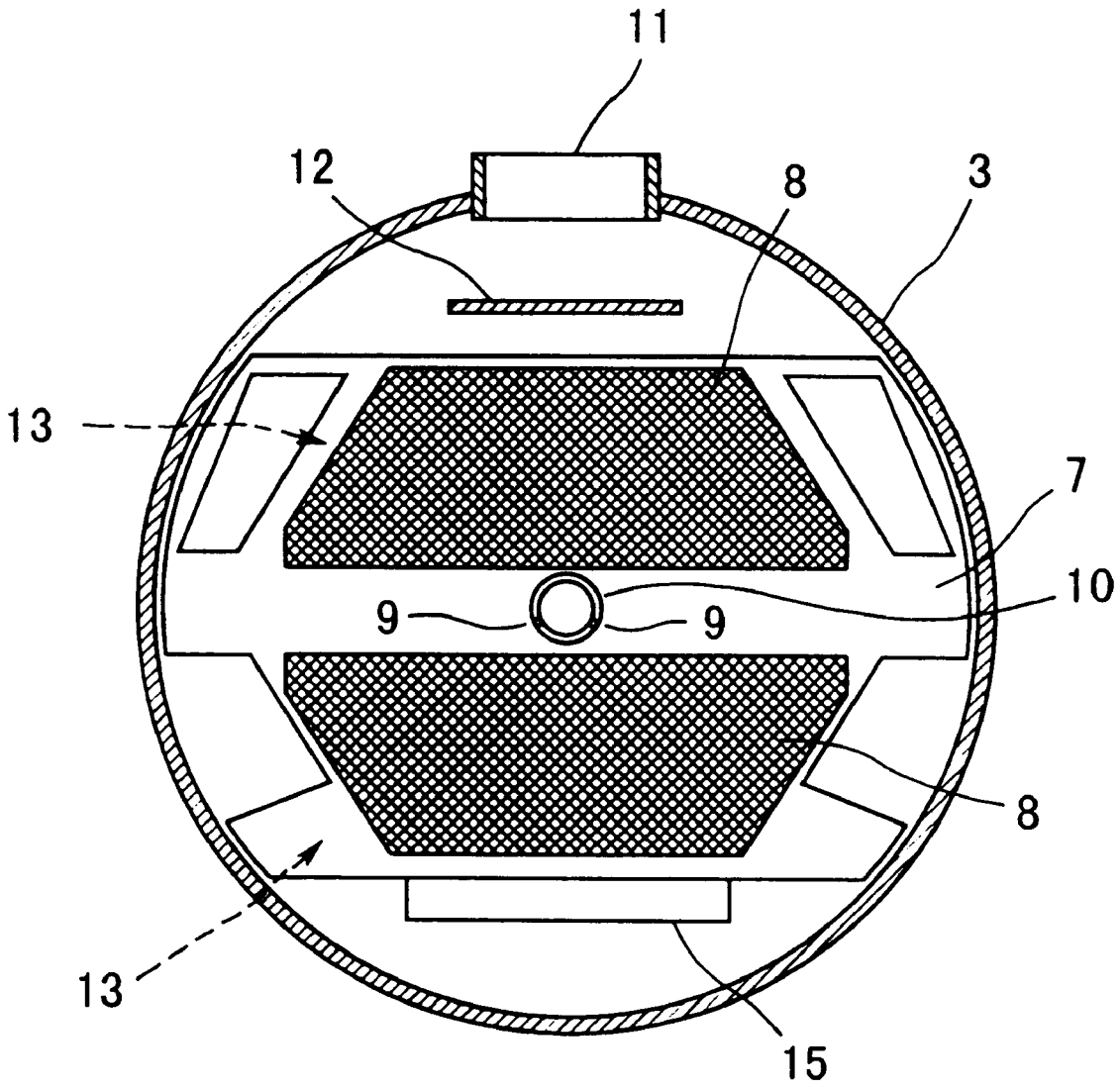
FIG. 10 PRIOR ART
FIG. 10 is a cross sectional view taken along an arrow X—X in FIG. 9.
Figure 11:
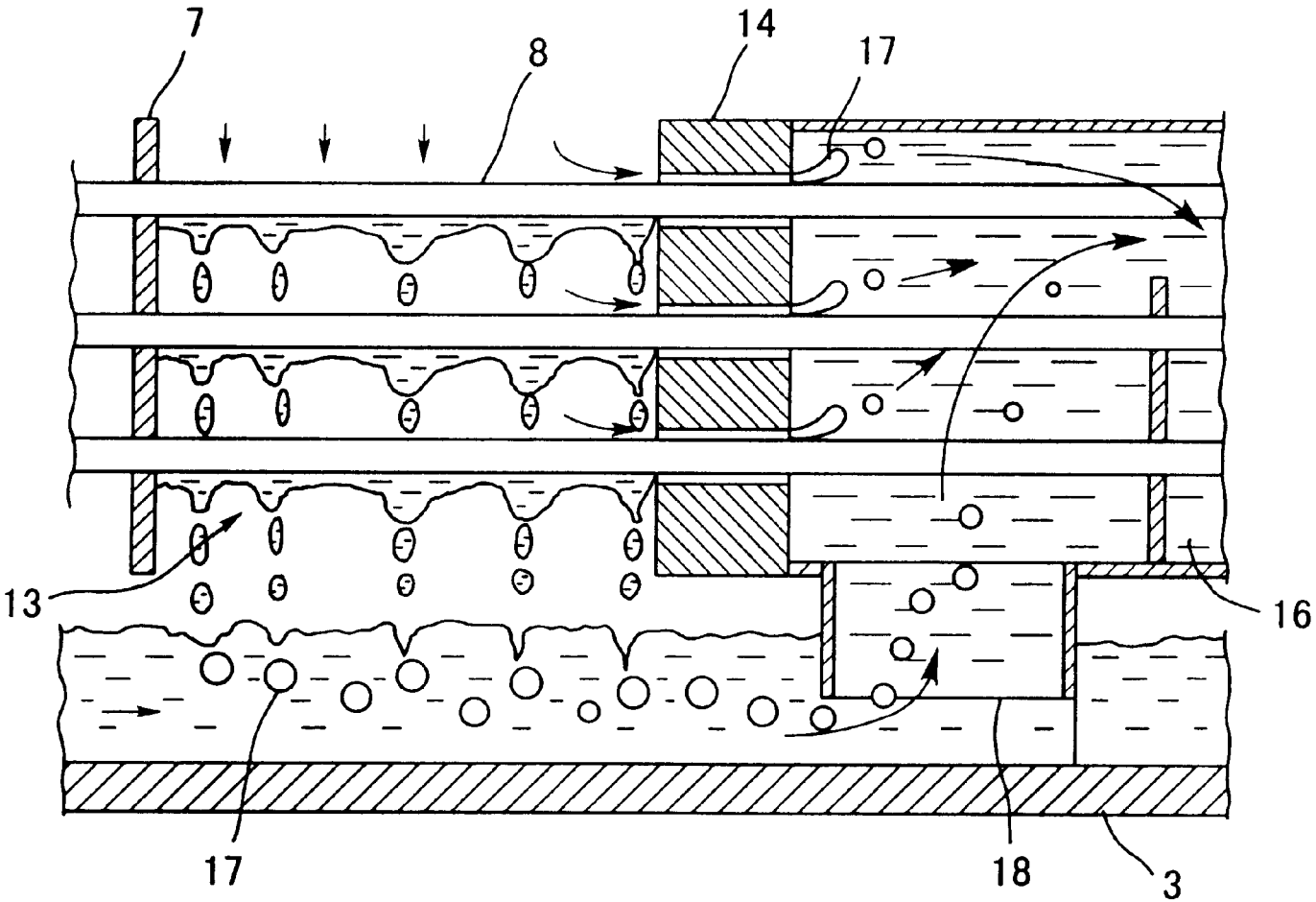
FIG. 11 PRIOR ART
FIG. 11 is a partially enlarged view of a portion XI in FIG. 9.

FIG. 8 is a longitudinal sectional view schematically showing a fourth modified example of the feed water heater according to the present invention, in which like reference numerals are used to designate the same components as those described in the embodiment of FIGS. 1–3, and the overlapping explanation is hence omitted hereunder.

In this example, the cylindrical shell 21 is provided with another steam inlet 58 at an outer wall section thereof, the heat exchanger tubes 26 is provided with a non-condensable gas vent tube 60 which is formed with suction ports 59 along the axial direction and extends to the axial direction, at the center of the heat exchanger tubes 26.

The another steam inlet 58 is located on a position of the cylindrical shell at which a steam inflow rate is balanced with that of the steam inlet 27 in the heat exchanging process. Further, the steam as a heating source flowing into another steam inlet 58 may be turbine extraction, or may be a drain of other equipments. The non-condensable gas vent tube 66 provided on the center of the heat exchanger tubes 26 is used for removing a non-condensable gas which has not still been removed in the non-condensable gas chamber 31.

As described above, in this example, one side of the cylindrical shell 21 is provided with a plurality of steam inlets 27 and 58, and a pitch between one steam inlet 27 and another steam inlet 58 is suitably set, that is, these inlets 27 and 58 are located on positions at which a balance of inflow steam rate is taken. Further, the U-shaped heat exchanger tube 26 is provided with the non-condensable gas vent tubes 60 at the center thereof so that a non-condensable gas which has not still been removed in the non-condensable gas chamber 31 can be removed. Therefore, a heat exchange with the feed water is made in a balanced state so as to provide almost no local stagnation of steam, and it is possible to supply a drain having a low dissolved oxygen gas concentration to the drain cooling section 29, and further, the drain cooling section 29 can be kept in a stable state so as to cause almost no corrosion.

It is to be noted that the present invention is not limited to the described embodiments and many other changes and modifications may be made without departing from the scopes of the appended claims.

What is claimed is:

1. A feed water heater comprising:

a cylindrical shell portion constituting a main body portion of a feed water heater;

a water box operatively connected to the cylindrical shell portion and partitioned by a tubesheet;

a heat exchanger tube bank arranged in the cylindrical shell portion and supported by support means composed of a plurality of support plates;

a drain cooling section, disposed in association with the heat exchanger tube bank, for carrying out a recovery of heat generated in the heat exchanger tube bank;

a steam supply means provided in an outer wall section of the cylindrical shell portion for supplying steam as a heating medium;

a dilution condensing chamber provided for the heat exchanger tube bank and adapted to flow the steam excessively into the heat exchanger tube bank; and a non-condensable gas chamber provided for the heat exchanger tube bank for almost completely condensing the steam;

wherein said dilution condensing chamber is located at a portion adjacent to a drain inlet of the drain cooling section and said non-condensable gas chamber is located at a portion adjacent to said dilution condensing chamber so that said dilution condensing chamber is disposed between said non-condensable gas chamber and said drain cooling section;

wherein said dilution condensing chamber has a box-shaped structure utilizing the support plates and is positioned substantially perpendicular to said steam supply means.

2. A feed water heater according to claim 1, wherein said dilution condensing chamber is provided with a flow guide disposed on a side of said steam supply means so as to surround an outer side of the heat exchanger tube bank.

3. A feed water heater according to claim 2, wherein said flow guide is formed with a steam port and has a semi-circular structure so as to surround the outer side of the heat exchanger tube bank with a space therebetween.

4. A feed water heater according to claim 3, wherein said flow guide has end portions bent inward.

5. A feed water heater according to claim 1, wherein said box-shaped dilution condensing chamber has a bottom portion which is closed by a blocking plate in which a drain outlet is formed in a lattice arrangement.

6. A feed water heater according to claim 5, wherein said blocking plate having the drain outlet in the lattice arrangement is composed of a perforated plate.

7. A feed water heater according to claim 5, wherein said blocking plate having the drain outlet in the lattice arrangement is composed of a netted flat plate.

8. A feed water heater according to claim 5, wherein said blocking plate having the drain outlet in the lattice arrangement is composed of a lattice plate.

9. A feed water heater according to claim 5, wherein said drain outlet, formed in the blocking plate, is composed of louver means, said louver means comprising flat plates having an opening with an inclination to the heat exchanger tube bank.

10. A feed water heater comprising:

a cylindrical shell portion constituting a main body portion of a feed water heater;

a water box operatively connected to the cylindrical shell portion and partitioned by a tubesheet;

a heat exchanger tube bank arranged in the cylindrical shell portion and supported by support means therein;

a drain cooling section, disposed in association with the heat exchanger tube bank, for carrying out a recovery of heat generated in the heat exchanger tube bank;

a steam supply means provided for the cylindrical shell portion for supplying steam as a heating medium;

a dilution condensing chamber provided for the heat exchanger tube bank and adapted to flow the steam excessively into the heat exchanger tube bank; and a non-condensable gas chamber provided for the heat exchanger tube bank for almost completely condensing the steam;

wherein said support means is composed of a plurality of support plates supporting the heat exchanger tube bank, said dilution condensing chamber has a box-shaped structure utilizing the support plates and extending along a direction perpendicular to a location of said steam supply means formed as a steam inlet to an outer wall section of the cylindrical shell portion;

further wherein said box-shaped dilution condensing chamber has a bottom portion which is closed by a blocking plate and is provided with louver means composed of flat plates which face the blocking plate with an inclination to the blocking plate.

11. A feed water heater according to claim 10, wherein said dilution condensing chamber is provided with a drain chamber which is formed by a section plate defining the drain cooling section and a partition plate.

12. A feed water heater according to claim 10, wherein said dilution condensing chamber is separated from said non-condensable gas chamber by one of said support plates to which a steam inlet is formed.

13. A feed water heater according to claim 12, wherein said steam inlet has an egg crate shape.

14. A feed water heater according to claim 13, wherein said egg crate structure is formed by assembling thin plates in an inclining lattice arrangement.

15. A feed water heater according to claim 10, wherein said non-condensable gas chamber is operatively connected to said dilution condensing chamber and is formed with a non-condensable gas collection port surrounded by baffle means.

16. A feed water heater according to claim 15, wherein said baffle means is composed of a plurality of baffle plates which are arranged to cause a meandering steam flow.

17. A feed water heater according to claim 15, wherein said non-condensable gas chamber is formed with a steam inlet port which is formed to each of the support plate partitioning said dilution condensing chamber and another support plate opposite thereto.

18. A feed water heater according to claim 10, wherein another steam supply means is formed on the outer wall section of the cylindrical shell so that a balance of inflow steam rate is taken with respect to said first mentioned steam supply means.

19. A feed water heater according to claim 18, further comprising a non-condensable gas vent tube disposed at substantially a central portion of the heat exchanger tube bank so as to extend along an axial direction of the cylindrical shell portion and operatively connected to said non-condensable gas chamber.

20. A feed water heater according to claim 19, wherein said non-condensing gas vent tube is formed with a plurality of suction ports along an axial direction thereof for sucking the steam.

21. A feed water heater according to claim 10, wherein said heat exchanger tube bank has substantially a U-shaped arrangement.

* * * * *